US008585317B1

(12) United States Patent
Sina

(10) Patent No.: US 8,585,317 B1
(45) Date of Patent: Nov. 19, 2013

(54) VIBRATORY COMPACTING ROLLER MACHINE WITH AN ELECTRIC DRIVE

(75) Inventor: Paul Sina, Jackson, WI (US)

(73) Assignee: Wacker Neuson Production Americas LLC, Menomonee Falls, WI (US)

( * ) Notice: Subject to any disclaimer, the term of this patent is extended or adjusted under 35 U.S.C. 154(b) by 0 days.

(21) Appl. No.: 13/466,239

(22) Filed: May 8, 2012

(51) Int. Cl.
*E01C 19/38* (2006.01)
*E01C 19/40* (2006.01)

(52) U.S. Cl.
USPC ..... 404/117; 404/84.1; 404/122

(58) Field of Classification Search
USPC ..... 404/113, 117, 122, 127, 131, 84.05, 404/84.1
See application file for complete search history.

(56) References Cited

U.S. PATENT DOCUMENTS

| | | | | |
|---|---|---|---|---|
| 5,564,375 | A * | 10/1996 | Orzal | 123/179.3 |
| 5,816,741 | A * | 10/1998 | Troppman, III | 404/117 |
| 6,397,965 | B1 * | 6/2002 | McFarlane et al. | 180/298 |
| 6,698,974 | B2 * | 3/2004 | Codina et al. | 404/117 |
| 6,827,524 | B2 * | 12/2004 | Starry et al. | 404/129 |
| 7,059,802 | B1 | 6/2006 | Geier et al. | |
| 7,168,885 | B2 * | 1/2007 | Rio et al. | 404/72 |
| 2006/0113122 | A1 * | 6/2006 | Persson | 180/19.1 |
| 2011/0024212 | A1 | 2/2011 | Adra | |
| 2011/0295453 | A1 | 12/2011 | Betz et al. | |

FOREIGN PATENT DOCUMENTS

| | | | | |
|---|---|---|---|---|
| JP | 2141041 | * | 4/2007 | B60W 10/08 |
| WO | WO2004/106096 | * | 12/2004 | B60K 6/04 |

OTHER PUBLICATIONS

Dynapac "Zero Diesel Gasoline Emissiion Concept Roller CC900E" Brochure.
Jacobsen "Eclipse 322" Brochure.

* cited by examiner

*Primary Examiner* — Raymond W Addie
(74) *Attorney, Agent, or Firm* — Boyle Fredrickson, S.C.

(57) ABSTRACT

A vibratory roller machine includes a chassis supported on one or more drum assemblies including an exciter assembly for compacting the ground on which the machine travels. The machine is operated via a number of drive and exciter motors powered by a series hybrid drive system. The series hybrid drive system includes an engine and generator that are configured to provide power to the system under nominal operating conditions. The series hybrid drive system further includes a power storage system, such as battery bank or a capacitor bank that is configured to provide the motors with additional power during peak power demand. The vibratory roller machine may, for example, be a walk-behind trench roller or ride-on roller.

19 Claims, 4 Drawing Sheets

VIBRATORY COMPACTING ROLLER MACHINE WITH AN ELECTRIC DRIVE

BACKGROUND OF THE INVENTION

1. Field of the Invention

The invention generally relates to a vibratory compactor used, e.g., to compact backfilled trenches after a pipeline is laid or to compact the floor of a trench or to compact asphalt or larger areas, and more particularly, relates to a vibratory compactor of the above-mentioned type having an electric drive.

2. Discussion of the Related Art

Vibratory compactors are used in a variety of ground compaction and ground leveling applications. Most vibratory compactors have plates or rollers that rest on the surface to be compacted and that are excited to vibrate so as to compact and level the worked surface. A common vibratory compactor, and one to which the invention is well-suited, is a vibratory trench roller.

The typical vibratory trench roller includes a chassis supported on the surface to be compacted by one or more rotating drum assemblies. Two drum assemblies are typically provided, each of which may support a respective subframe of the chassis if the trench roller is an articulated trench roller. The subframes may be articulated to one another by a pivot connection. Each of the drum assemblies include a stationary axle housing and a drum that is mounted on the axle housing and that is driven to rotate by a dedicated hydraulic motor. Both hydraulic motors are supplied with pressurized hydraulic fluid from a pump powered by an internal combustion engine mounted on one of the subframes. In addition, each drum is excited to vibrate by a dedicated exciter assembly that is located within the associated sub-frame and is powered by a hydraulic motor connected to a pump. The exciter assembly typically comprises one or more eccentric masses mounted on a rotatable shaft positioned within the sub-frame. Rotation of the eccentric shaft imparts vibrations to the sub-frame and to the remainder of the drum assembly. The entire machine is configured to be as narrow as possible so as to permit the machine to fit within a trench whose floor is too compacted. Machine widths of less than 3 feet (1 meter) are common. Vibratory trench rollers of this basic type are disclosed, e.g., in U.S. Pat. Nos. 4,732,507 to Artzberger, 5,082,396 to Polacek, and 7,059,802 to Geier et al., the entireties of which are hereby expressly incorporated by reference thereto.

The hydraulic systems of vibratory trench rollers of the kind generally known in the art are configured to control the functions thereof including forward and reverse travel, steering, and vibratory excitation. Hydraulic power is produced by hydraulic pumps connected to the engine. Pressurized fluid from the pumps is routed by a hydraulic manifold to the hydraulic motors and cylinders to control the operations of the machine. Low-speed hydraulic motors drive the drums through a gear reduction, and vibratory excitation is generated by a hydraulic motor driving eccentric shafts at high speeds. Hydraulic fluid, typically oil, flows through a heat exchanger and a filter prior to returning to the reservoir in order to maintain system performance and reduce wear on the hydraulic components.

The typical hydraulic systems, though adequately operating and carrying out the functions of the machine, exhibit several drawbacks and disadvantages. First, as in any hydraulic system, there is the potential for leaks at any connection point along the system. The amount of vibratory excitation present in trench rollers of the kind under consideration herein only exacerbates this problem. Over time, the vibrations experienced can cause the hydraulic fittings to loosen and the hoses to fail from abrasion with other components and/or hoses. In the case of a hydraulic fluid leak, the roller may cease to operate and/or hydraulic fluid may leak onto and contaminate the surrounding soil.

In addition, hydraulics are inefficient as compared to other types of power transfer. Such system inefficiencies result in an undesirable amount of heat generation which is transferred through the fluid to the other hydraulic components in the system. This heat must be eliminated so as to prevent damage to the components of the machine, which adds to the complexity, cost, and inefficiencies of the overall system.

Moreover, the hydraulic valves necessary to control the flow of the hydraulic fluid through the system are quite costly. Many different valves are required to perform the functions required of vibratory trench rollers thus substantially increasing the costs associated with the production of such machines. Further, simple hydraulic controls act in an on-off manner. Thus, the flow of hydraulic fluid to components is generally started and stopped very quickly. Relief valves are inserted into the system to limit the pressures generated by these quick changes to flow. As noted previously, valves are quite costly. The additional relief valves add to the cost of the machine. Further, the addition of a number of components such as relief valves only increases the number of elements capable of failure and requiring maintenance or replacement. Hydraulic functions could be activated in a more controlled manner using proportional valves. However, such valves are even more expensive and require more complicated control systems to drive them so they are generally not cost effective for vibratory trench rollers and similar machines.

As noted above, simple hydraulics operate in an on-off manner and create high pressure spikes during transition. The high pressure conditions last only a short time (under 2 seconds) but the engines that power hydraulic systems must be sized so that the engine does not bog down under maximum power draw, such as occurs when engaging the exciter while traveling up a slope. If a machine seldom operates under these conditions, as is often the case for vibratory trench rollers, the engine operates at less than peak efficiency the vast majority of the time. In other words, the engine needs to be considerably oversized so as to be capable of meeting relatively infrequent but steep spikes in demanded power. A larger engine, of course, also costs more and requires more fuel.

Finally, hydraulic hoses must be sized according to the flow requirements of the system. These hoses can measure more than one-inch in diameter. The coverings for the hoses are generally constructed to resist abrasive wear, which makes it difficult to bend or otherwise manipulate the hoses. As such, it is rather difficult to route multiple hoses in a relatively confined space.

The foregoing drawbacks and disadvantages result in a number of system shortcomings and failures including, but not necessarily limited to, hydraulic leaks caused by loose-fitting or damaged o-rings, exciter motor shaft seal failures or housing cracks, hose abrasion damage, hydraulic manifold leaking, and/or cartridge valve failure. Further, such system failures commonly occur in and affect the components inside the sub-frames and these issues are often time-consuming and therefore costly to remedy. The compact design of the rollers requires that the components thereof be placed in tight locations that are often blocked or impeded by other components of the roller. As such, it can be quite difficult to determine the location of and repair a leak.

Other types of vibratory compacting machines employ similar hydraulic drives and suffer from the same or similar drawbacks heretofore described. In addition, certain other types of vibratory compacting machines, such as ride-on rollers used for compacting soil or smoothing asphalt, also suffer from additional drawbacks.

For example, the hydraulic systems of ride-on rollers have a number of inefficiencies that require these rollers to use an engine large enough to operate all of the systems of the roller at peak pressures. For instance, the exciter systems of ride-on rollers are usually controlled with simple on-off hydraulic valves that start and stop the flow of hydraulic fluid to the exciter motor very quickly. Rapidly accelerating the exciter mass from stop to the rated operation speed requires a large amount of torque. Once the exciter is at operating speed, the torque requirements are greatly reduced. Torque is generated when the high pressure hydraulic fluid from the pump attached to the engine flows through the hydraulic motor. High pressures and high flows require more power from the engine.

In addition, ride-on rollers usually do not require the full torque of the drive system during use. High torque is required only when operating on steep hills, loading or unloading from a trailer, or when the machine operates in loose soil. This high torque may be required from 1-50% of the duty cycle depending on the specific application. Thus, the engine must be sized to meet these peak pressure and flow demands. However, as with trench rollers and other compactors, such high-load operating conditions are present for only a limited amount of the operational time, which may be as low as 1%. The extra engine power capacity therefore is seldom used. By requiring a larger engine for what amounts to a small fraction of the time of the overall operation of the machine, the overall size, weight, and cost of the roller is greatly increased.

Further, the drive systems used in modern ride-on rollers are typically also hydraulic, but these drive systems are different than those used in trench rollers. Ride-on rollers use a hydrostatic pump that is able to proportionally control the flow rate of the hydraulic fluid of the pump. These pumps provide variable speed and eliminate the on-off nature of the simple hydraulic valves. However, hydrostatic pumps are less efficient and also operate as a so-called "closed loop" system that can require additional measures for removing heat to avoid component damage.

Many hydrostatic drive systems for ride-on rollers are comprised of two parallel loops, one for the front drum and one for the rear drum. The hydraulic fluid in these systems flows to the path of least resistance so if one drum loses traction it will get all of the flow. A flow divider is sometimes used on these machines to provide so-called "traction control" for these situations. Flow dividers create additional heat and add to the complexity and cost of the roller. Hydrostatic pumps are also directly coupled to the engine, so they are constantly being driven, creating a parasitic load on the engine even when the machine is not moving. Finally, such hydrostatic drive systems are relatively expensive.

In addition, ride-on rollers typically are used in a cyclical manner, i.e. driving back and forth over a section of soil or asphalt to compact the surface. The cyclical operation of the machine requires energy to accelerate and decelerate the machine as it changes direction. The cyclical operation of the machine can also create varying levels of power required to drive the system, i.e. compacting material on a slope will require more power to drive up the slope than to drive down.

The need therefore exists to provide a drive system for a vibratory roller of the like that eliminates one or more of the foregoing disadvantages.

SUMMARY OF THE INVENTION

In accordance with a first aspect of the invention, at least one of the above-identified needs is met by providing a vibratory roller machine supported on a front and rear drum assembly. The drum assemblies include respective exciter assemblies, and the machine and exciter assemblies are powered by a number of corresponding exciter and drive motors. The exciter and drive motors are powered by a series hybrid drive system. The machine may be a vibratory trench roller, a ride-on roller, or any other roller of the aforementioned general type. The roller may be an articulated roller having front and rear subframes pivotally connected to one another.

The series hybrid drive system comprises an engine and generator that operate in cooperation with one another to power the components of the vibratory roller machine. The engine may be two stroke or four stroke engine and may be powered by, e.g. spark ignition or compression ignition. The engine drives the generator to generate electric power that is used to deliver power to 1) electrically powered components of the machine such as exciter motor(s) and/or drive motor(s) and/or 2) a power storage system. The power storage system also selectively delivers power to the electrically powered components of the machine. In a preferred embodiment, the power storage system is a reserve power system that supplements the power being delivered by the generator when the prevailing power demand exceeds the available power output from the generator. The power storage system may, for example, take the form of one or more battery banks and/or one or more capacitor banks.

A controller may be provided in operative communication with the engine and generator combination and the power storage system. If the power storage system is a reserve power system, the controller may be configured to monitor the demanded the power requirements of the machine and to compare them with the available power output from the generator. If the demanded power requirements exceed the available power output, then the controller may cause the machine to draw power from the power storage system either exclusively or as a supplement to that being delivered by the generator. In the alternative, if the prevailing power requirements do not exceed the available generator power output, then the controller may direct the machine to draw power solely from the engine and generator and to direct any excess power to the power storage system for charging.

A method of controlling the operation of a series hybrid power system for a vibratory compaction roller is also disclosed herein.

The vibratory roller machine may be a walk-behind trench roller or a ride-on roller having an operator platform including a steering and control assembly for operating the machine.

Various other features, embodiments and alternatives of the present invention will be made apparent from the following detailed description taken together with the accompanying drawings. It should be understood, however, that the detailed description and specific examples, while indicating preferred embodiments of the invention, are given by way of illustration and not limitation. Many changes and modifications could be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings, in which like reference numerals represent like parts throughout, and in which.

DETAILED DESCRIPTION OF THE PREFERRED EMBODIMENTS

Figure 1:
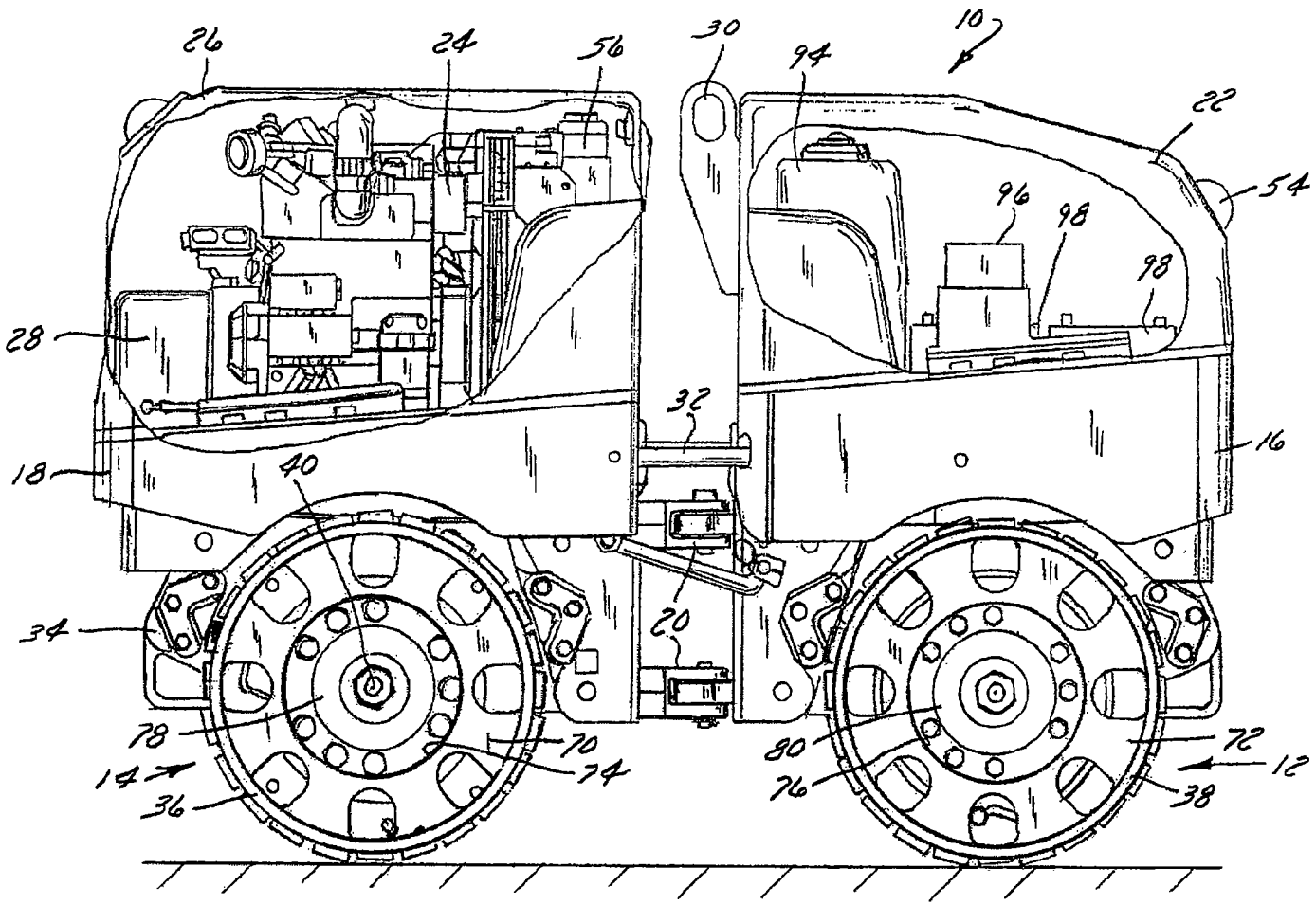
FIG. 1 is a side elevation view of a walk-behind vibratory roller machine comprising a drive system according to an embodiment of the present invention.

Referring now to the drawings, and initially to FIG. 1, a vibratory trench roller 10 (alternatively, machine 10) is illustrated in accordance with a preferred but exemplary embodiment of the invention. The roller 10 is a so-called walk-behind trench roller comprising a self-propelled machine supported on the ground via rear and front rotating drum assemblies 12 and 14, respectively. The roller 10 comprises an articulated chassis having rear and front subframes 16 and 18 connected to one another via a pivot connection 20. The chassis is only about 20 inches (50 cm) wide. This narrow width is important to permit the roller 10 to be used to compact the bottom of trenches for laying pipeline and the like. The rear subframe 16 supports controls for the machine (not shown) as well as an enclosed storage compartment accessible via a pivotable cover 22. These controls may include a transmitter and/or a receiver 54 mounted on the machine for sending and/or receiving signals to a remote control. The front subframe 18 supports an engine 24 accessible via a ventilated hood 26. The engine 24 supplies motive power to a generator 28 that generates power used to drive the powered components of the roller 10. The engine 24 and generator 28 form part of a series hybrid drive system discussed in more detail below. A radiator 56 is also provided in close proximity with the engine 24 for cooling thereof. The roller 10 can be lifted for transport or deposited in a trench whose floor is to be compacted by connecting a chain or cable to a lift eye 30 located at the front of the rear subframe 16. The roller 10 may be steered by an actuator shown here as a linear actuator 32 extending between the rear and front subframes 16 and 18 along a line that is offset from the center of the pivot axis of the articulated subframes. Movement of the linear actuator 32 causes the subframes 16 and 18 to pivot relative to one another, thereby steering the roller 10. The linear actuator 32 may be driven by way of a solenoid or other similar element known in the art. Alternatively, the roller 10 may be steered by a hydraulic system of the kind generally known in the art. In particular, the roller 10 may include a hydraulic motor and corresponding actuators coupled thereto for steering of the roller 10. Actuators other than linear actuators could be employed as well. Instead of or in addition to operating the linear actuator, the roller could be steered through differential rotation of the drive drums on opposite sides of the front and/or rear ends of the machine 10.

The rear and front drum assemblies 12 and 14 are mirror images of one another. The primary difference between the two drum assemblies is that the drive motor for the exciter assembly of the front drum assembly 14 is mounted in the associated axle housing from the right side of the machine 10, and the drive motor for the exciter assembly for the rear drum assembly 12 is inserted into the associated axle housing from the left side of the machine 10.

As is generally understood in the art, each drum assembly 12 and 14 is excited to vibrate by a dedicated exciter assembly (not shown) that is located within the associated axle housing and that is powered by a drive system as will be discussed in additional detail herein. The exciter assembly typically comprises one or more eccentric masses (not shown) mounted on a rotatable shaft(s) (not shown) positioned within the axle housing 34. Rotation of the eccentric shaft imparts vibrations to the axle housing and to the remainder of the drum assembly. In this way, the drum assemblies 12 and 14 are operable to compact the ground as is generally understood.

The construction and operation of the front drum assembly 14 will now be described, it being understood that the description applies equally to the rear drum assembly 12. The front drum assembly 14 includes an axle housing 34 a pair of drum sections 36 and 38 that are of corresponding construction and which mirror one another to form the front drum assembly 14. The drum sections 36 and 38 surround opposite sides of the axle housing 34 and are mounted on the axle housing 34 by a common axle 40.

The axle housing 34 is a cast metal housing that is generally tubular in shape and that has open ends (not shown). The axle housing 34 may additionally include a mounting frame that extends longitudinally of the machine 10 and that is connected to the front subframe 18 of the machine by a number of mounts (not shown).

The drum sections 36 and 38 are mounted on opposite sides of the mounting frame of the drum housing 34 so as to surround the axle housing 34. The outer surface of each drum portion 36 or 38 could be smooth, but is provided with a so-called sheep's foot surface in the illustrated embodiment so as to have compaction lugs or sheep's feet formed thereon. Each of the drum sections 36, 38 also extends laterally beyond the end of the axle housing 34 by an amount that determines the compaction width of the machine 10. In the illustrated embodiment in which the machine 10 is configured to compact a 32" (82 cm) wide strip, each of the drum sections 36, 38 extends beyond the associated sub-frame by several inches. In an application in which the machine 10 is configured to compact a 22" (56 cm) wide strip, each drum section 36, 38 would be generally flush with the associated sub-frame. Each of the drum sections 36, 38 also has an internal flange 70, 72 having a central aperture 74, 76 for receiving an axle support hub 78, 80. The axle 40 extends between the hubs 78, 80 and through the center of the axle housing 34. The axle 40, and hence the drum sections 36, 38, are supported on the cover plates (not shown) of the axle housing 34 via inner races of the bearings (not shown). The axle 40 is driven to rotate by a driven gear (not shown) that is mounted directly on the axle 40 and that is driven by a series hybrid drive as will be discussed in addition detail below.

Figure 2:
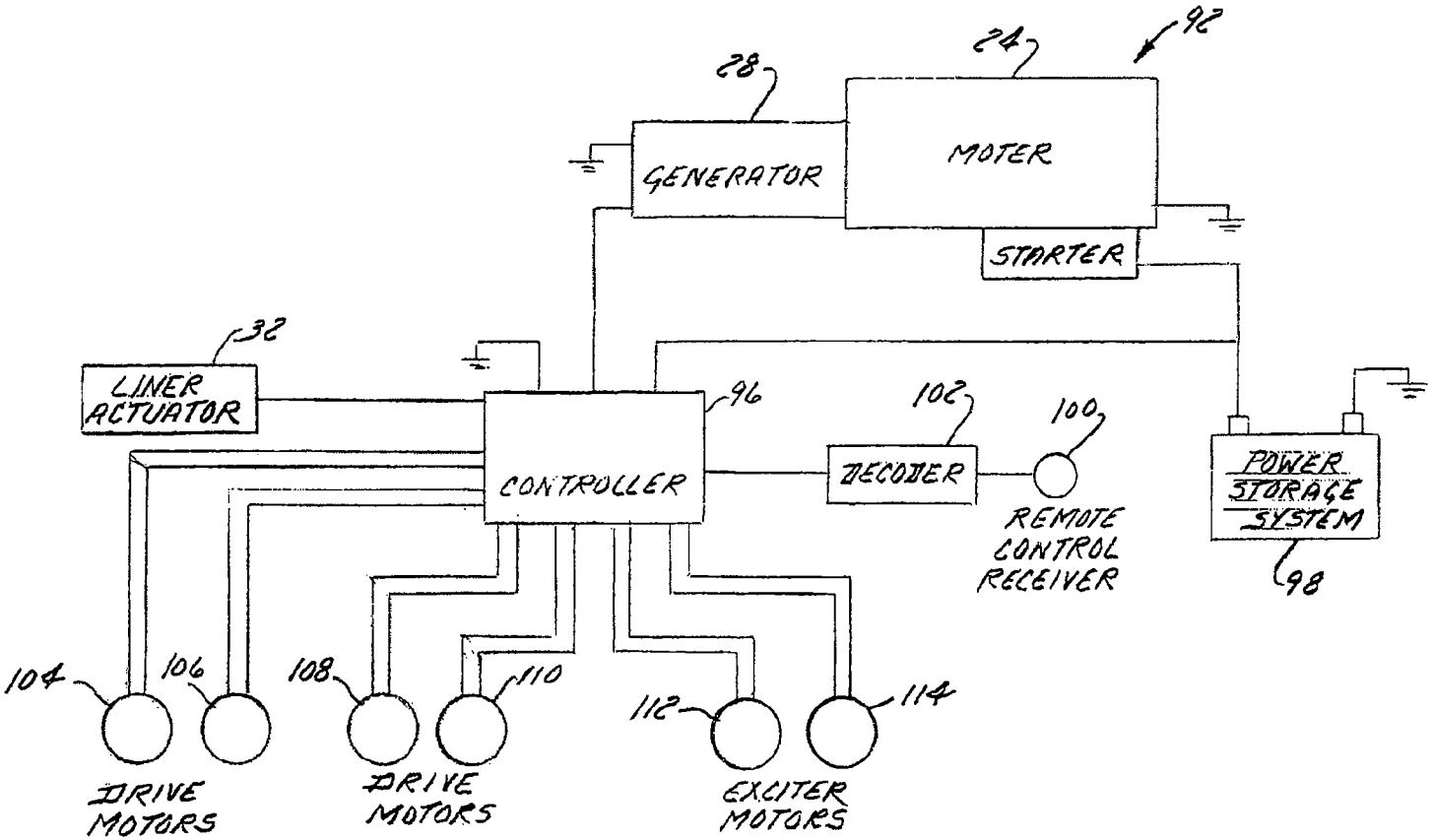
FIG. 2 is a schematic diagram of the drive system of the machine of FIG. 1.

Referring now to FIG. 2, all powered components of the machine, including the exciter assemblies and drive assemblies of the drum assemblies 12 and 14 and the linear actuator 32 for steering the machine, are driven by a series hybrid drive 92. Alternatively, as mentioned above, the linear actuator and possibly other powered components could be actuated hydraulically or from another source, not shown.

Series hybrid drive system 92 includes the aforementioned engine 24 and generator 28, as well as a fuel tank 94 and a power storage system 98. The power storage system of this embodiment comprises a battery bank comprising one or more batteries housed within the rear sub-frame 16 that are in communication with the engine 24 and the generator 28. Depending on the power requirements of a particular machine, the battery bank could be supplemented by or even replaced by a capacitance bank. Operation of and power transfer between the motor 24, the generator, the power storage system 98, the linear actuator 32, and the powered components of the machine 10 are controlled by a controller or ECU 96.

The series hybrid drive system 92 further comprises a number of electric components such as wires and connectors (not shown) that effectively replace the hoses and fittings, respectively, of traditional, hydraulically-driven rollers 10 of the kind previously discussed herein. As the wires and connectors are smaller and more flexible than the hoses and fittings, routing of the electric components will be easier and result in less congestion between the internal components that often makes performing maintenance and repairs on rollers 10 difficult. The wires and connectors of the machine 10 may be configured for carrying out various operations and communications amongst the components of the machine 10, such as the communication between the controller 96 and the individual motors of the drive and exciter systems, as will be discussed in further detail herein, as well as for transmitting warning and informational indications to the operator of the machine 10.

In the series hybrid system 92 according to this embodiment of the present invention, the electrical power for the roller 10 is provided by the engine 24, which may be in the form of a gas (spark ignited) or diesel (compression ignited) two stroke or four stroke engine. The engine 24 powers the generator 28, and the electrical power from the generator 28 is directed to the electrical components, e.g. motors, actuators. The electrical power from the generator 28 also preferably is used to charge the power storage system 98. The generator 28 may be configured to provide power to the system in an adjustable manner. For example, the power transmitted to the electrical components from the generator 28 may be selectively or automatically adjusted according the prevailing needs of the machine 10. This adjustment may be controlled manually by the operator and/or automatically by the controller 96 under feedback. The components that are electrically powered by the generator 28 and/or the power storage source 98 include rear drive motors 104, 106 that drive the left and right rear drums, respectively, front drive motors 108, 110 that drive the left and right front drums, respectively, and exciter motors 112, 114 that drive the front and rear exciter assemblies, respectively. In an alternative embodiment of the present invention, a single rear drive motor and a single front drive motor may be provided for driving the respective left and right rear drums and the left and right front drums through a single axle as may be generally understood. In a preferred embodiment, the system 92 may be configured to run primarily on the generator 28 while the power storage system provides supplemental power during peak operating conditions or in the absence of sufficient power from the generator 28. The power storage system 98 thus operates primarily as a reserve or supplemental electrical power source, and the generator 28 acts as the primary electrical power source. In such an arrangement, the stored power required by the system 92 would be substantially less than in standard series hybrid systems, such as those commonly associated with passenger vehicles and the like, in which primary power is delivered by the batteries and supplemental or reserve power is delivered by the generator. Accordingly, fewer batteries or capacitors are necessary for operating the machine 10 according to a preferred embodiment.

Trench roller machines 10 like that of the present invention are subject to generally constant loads when compared to other vehicles employing series hybrid drives. In sharp contrast to passenger vehicles, trench rollers and similar machines require peak power for very short periods of time and only for a very small percentage of the machines' operating period. Trench rollers and similar machines also are not subject to shifting and typically are less prone than passenger vehicles to experiencing changes in the required power output due to, for example, changes in grade elevation. As one of the objectives of the present invention is to eliminate the hydraulics and associated problems typically associated therewith rather than providing a so-called "green" operating machine, the machine 10 may be configured to operate primarily on the generator 28 instead of battery power and still accomplish this objective.

In an alternative embodiment of the present invention, the system 92 may be configured to run primarily on power storage system 98. In such an embodiment, the power storage system serves as the primary power supply for the system 92 and the engine 24 and generator 28 may be configured to charge the power storage systems in a more traditional series hybrid system. In such systems, the vehicle, in this case machine 10, operates solely on stored power unless and until the stored power is entirely or nearly entirely exhausted and/or is insufficient to meet prevailing power draws, at which point the system is configured to supplement and replenish that stored power with or switch to the engine and generator.

As is generally understood, electrical components operate more efficiently than hydraulic components. Thus, the engine 24 may be less powerful as compared to that commonly used in a corresponding hydraulically-driven machine. The size of engine 24 may also be favorably impacted by the power storage and delivery capabilities of the power storage system 98. For example, if the power storage system 98 comprises a bank of batteries, the more batteries carried by the machine 10, the smaller the engine 24 that is required. In a preferred but exemplary embodiment, the engine 24 and the generator 28 are sized to supply slightly more power than is required to run the machine 10 under ordinary operating conditions. For example, the engine and generator could be sized such that the power required for "nominal" or steady state operation on level ground would consume 90-95% of the generated power, and the remaining 5-10% would be used to charge the batteries or comparable components of the power storage system. More power would be available for delivery to the power storage system when operating under lighter-than-standard load conditions, such as when the machine 10 is traveling down a grade. The power storage system would then provide reserve power in the instance of high-demand situations such as, for example, during exciter start up or when traveling up a steep grade. The generator 28 would then charge the power storage system 98 when the machine 10 is using less power than under nominal operating conditions. Accordingly, the engine 24 of the present invention is rendered smaller, quieter, and more fuel efficient than is ordinarily required to operate a similarly-sized machine 10. In the case of a trench roller having a compaction width of 32" (80 cm) the horsepower requirements of the engine can be reduced from 18 to 23 hp (13.4 to 17.2 kW) for a machine that has hydraulically powered motors to 13 to 16 hp (9.7 to 11.9 kW) for a machine that has electrically powered motors controlled in accordance with the embodiment of the invention described herein.

In addition, the controller 96 may be configured to ramp the output to the drive motors 104-110 and exciter motors 112 and 114 at start-up or during other transient operating conditions to limit current spikes. In this way, the peak power requirements for the engine 24 and can be reduced, thereby reducing the reliance on battery power. For example, instead of achieving top speed in the exciters within 0.5 second with hydraulic valves, the system 92 may be configured so that the top speed is achieved within 1.5 seconds or the like to thereby reduce the peak power requirements of the machine 10.

Understandably, these figures are merely exemplary and any number of variations are envisioned.

The removal of the hydraulic components and the use of a smaller engine 24 provide adequate space for the power storage system without having to change the "standard" dimensions of the machine 10. In the preferred case in which the power storage system takes the form of batteries, lead-acid batteries can be used because 1) they are cost effective 2) they have a large energy storage capacity, and 3) weight is not a major concern on trench and ride-on rollers With additional reference now to FIG. 2, a schematic view of the series hybrid drive system 92 according to the present invention is illustrated. As briefly discussed above, commands to the machine 10 may be made through a remote control system via the remote control receiver 100 configured to receive commands from a remote controller transmitter (not shown). A decoder 102 may be provided between the remote control receiver 100 and the controller 96 for decoding the signals sent from the remote control transmitter and received by the remote control receiver. The controller 96 directs the received signals and transmits the signals to the appropriate electrical component(s). In a preferred embodiment, the controller 96 is configured to direct power to the drive motors 104, 106 and 108, 110, exciter motors 112, 114, and actuator 32 as necessary to achieve the demanded results. The controller 96 may also be configured to monitor and synchronize the rotational speeds of the drive motors 104-110 and exciter motors 112 and 114.

The controller 96 may further be configured to monitor the system 92 and display and/or record routine maintenance or basic system information or warnings to the operator via the electrical connectors as previously discussed. For instance, the controller 96 may be configured to provide detailed troubleshooting information in regards to operating data, short or open circuits, out of range parameters, or other system faults of the kind generally known in the art, which may be useful in performing maintenance on the machine 10.

During operation of the trench roller 10, the roller 10 is positioned at the bottom of a trench or on another surface to be compacted, and the engine 24 and generator 28 supply power to the drive motors 104, 106, 108, and 110 which supply drive torque to the axles 40 of the drum assemblies 12, 14 via drive gears thereof, thereby propelling the trench roller 10 along the surface to be compacted. The exciter motors 112 and 114 (see FIG. 2) are simultaneously operated to supply drive torque to the exciter assemblies, thereby generating vibrations of a magnitude that vary depending upon the speed and direction of motor output shaft rotation.

As discussed previously, while the system 92 is described as having four drive motors 104-110, understandably, the system 92 may comprise more or fewer drive motors in keeping with the spirit of the invention. In at least one embodiment of the present invention, the drive motors may be configured to individually drive the front drum 12 and rear drum 14. Hence, four drive motors are provided in this embodiment. In another embodiment, the drive motors are configured to drive the front drum 12 and the rear drum 14 as a pair. Hence, two drive motors are provided.

In a preferred embodiment, the controller 96 is configured to monitor the power requirements of the drive motors 104-110 and the exciter motors 112 and 114 and then direct the supplemental or reserve power from the power storage system 98 to the drive motors 104-110 and/or exciter motors 112 and 114 as necessary. If the controller 96 determines that the system 92 is generating more power than necessary to power the components and charge the power storage system, a control loop may be provided to automatically throttle back the engine 24 to reduce its output from the generator to correspond to the current demand to thereby save fuel resources.

Similarly, the controller 96 may be configured to monitor the output so that the commanded speed or power output of the exciter or the drums 12, 14 may be reduced from that requested by the operator of the master controller to that which is actually capable of being delivered by the system 92 under prevailing operating conditions. For example, if the power storage system is depleted and the command received from the operator exceeds what is capable of being generated by the engine 24 operating at full speed, then the controller 96 may reduce the actual command power output to one that is less than that commanded by the operator but which is capable of being effectively delivered by the generator. It may also reallocate the available power from that being commanded. For example, some power could be diverted from the drive motors to the exciter motors to reduce vehicle speed while assuring adequate ground compaction.

In one preferred embodiment, the system 92 may be configured so that the engine 24 is sized to provide power equal to about the nominal mean power output that would be required for operation under normal operating conditions. In such a construction, the system 92 may then be configured so that during peak operating conditions, such as start up or traveling up grade, the power storage system may be utilized to complement the power output of the engine 24. In a preferred embodiment of the present invention, the drive system 92 may be configured to variably adjust the speed of the drive motors 104-110 and exciter motors 112 and 114. The system 92 may be equipped with regenerative measures or devices for capturing energy from the inertia of the spinning exciter shafts while the exciter motors 112 and 114 are turned off. Further, the system may be outfitted with proportional control with respect to steering and forward and reverse control, may provide a limited run-time for battery-only operation, and be configured to automatically adjust the engine speed based on the power requirements of the task at hand. In addition, the machine could have plug-in capabilities so that the power storage system 98 could be charged while the machine is not operating by being plugged into an electrical outlet.

Figure 3:
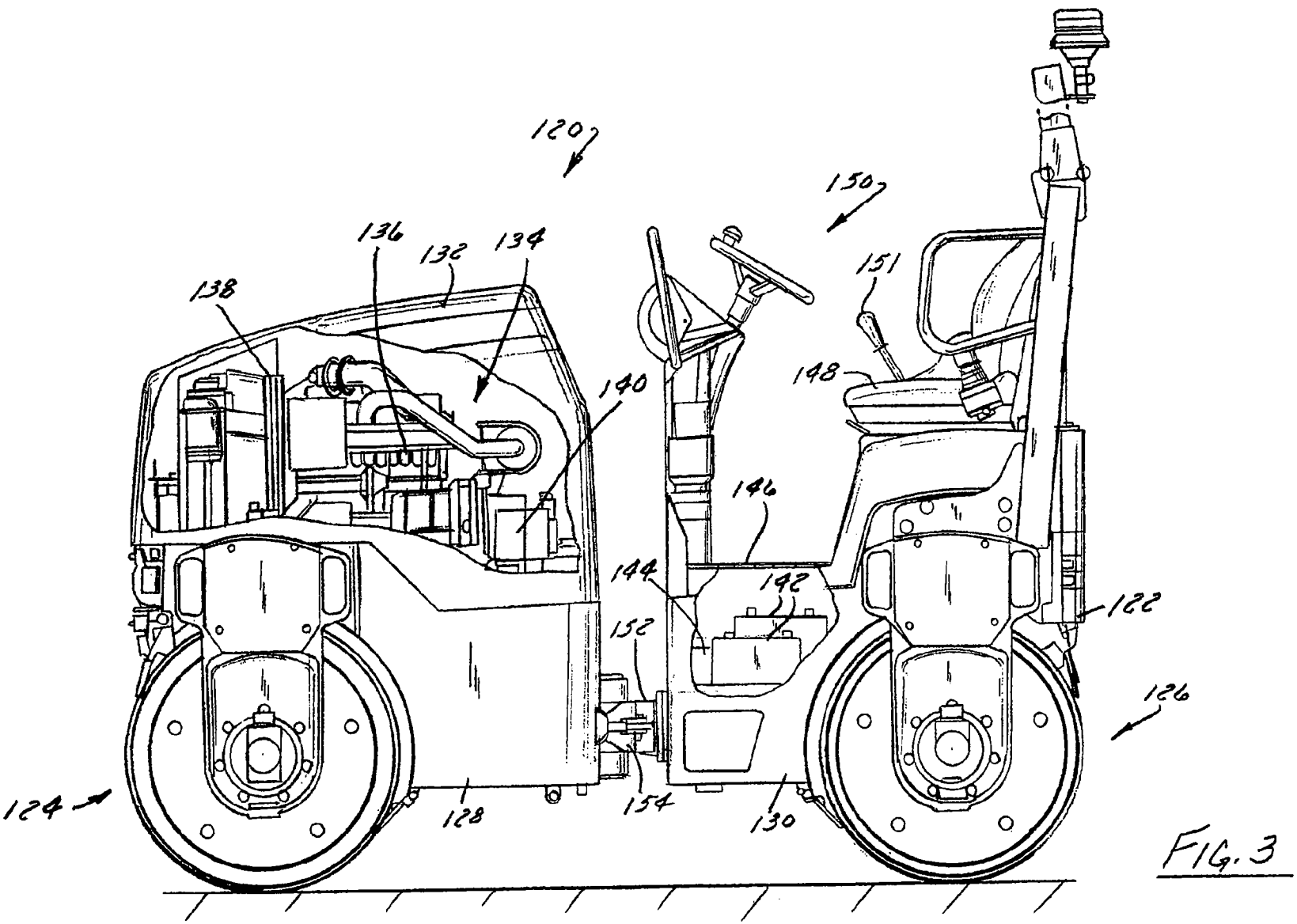
FIG. 3 is a side elevation view of a ride-on vibratory roller machine comprising a drive system according to an embodiment the present invention.

Referring now to FIG. 3 an alternative embodiment of the present invention comprises a double-drum ride-on roller machine 120. The machine 120 may be of the kind used to compact soil to provide a firm foundation for paving or to reduce the future settlement of soil. The machine 120 may also be utilized for compacting and smoothing asphalt to provide a durable surface to accommodate increased traffic and travel as is generally understood.

The machine 120 comprises a chassis 122 supported on the ground by a front drum assembly 124 and a rear drum assembly 126. The chassis 122 includes a front subframe 128 and a rear subframe 130. The front subframe 128 includes a hood 132 is selectively pivotable and which houses components of a drive system 134 of the present embodiment including an engine 136, which may be a diesel or gas engine, a radiator 138, and a generator 140. The rear subframe 130 houses a power storage system 142 that, in this embodiment, takes the form of a battery bank comprising a plurality of batteries. A controller 144 is also mounted on the rear subframe 130. In addition, the rear subframe 130 provides an operator support platform 146, which may include a seat 148 for supporting the operator. The rear subframe 130 may further include a steering assembly 150 such as a steering wheel, as well as a control (151) for controlling machine travel. The controls for travel may comprise an electronic joystick or similar device capable of providing a variable signal to the control module. The front subframe 128 and the rear subframe 130 are coupled to one another by way of a pivot connection 152 and may further be joined by a linear actuator 154 or similarly driven element for controlling movement as previously discussed as in the previous embodiment. As with the previous embodiment, the present embodiment of the machine 120 may incorporate a hydraulic motor and drive system for steering thereof.

As with the trench roller 10 of the previous embodiment, the drive system 134 of the ride-on roller 120 comprises a series hybrid drive system for providing power to operate the various functions of the ride-on roller 120. The series hybrid drive system 134 will utilize a smaller engine 136 for driving the generator 140 to supply power to the electrical components of the roller 120. In particular, in a preferred embodiment, the engine 136 is sized to provide enough power to run the machine at nominal conditions. The batteries 142 of the battery bank or other power storage system are then utilized to supply additional power to the electrical components during peak power situations as previously identified. Excess electrical power from the engine 136 and generator 140 combination would be used to replenish the batteries 142. The series hybrid drive system 134 will provide the ride-on roller 120 with similar benefits as previously discussed with respect to the roller 10. In the case of a ride-on roller having a compaction width of 47" (120 cm) the horsepower requirements of the engine can be reduced from 31 to 35 hp (23.1 to 26.1 kW) for a machine that has hydraulically powered motors to 24 to 29 hp (17.9 to 21.6 kW) for a machine that has electrically powered motors controlled in accordance with the embodiment of the invention described herein. Like the trench roller 10, the ride-on roller 120 may utilize a number of electric motors for operating the drive system and the vibratory exciters. Front and rear drive motors and front and rear exciter motors preferably are provided. The controller 144 is configured to monitor and synchronize the rotational speed of the drive motors as may be desired. In this way, the roller 120 is provided with "traction control" for the drive system while not appreciably increasing the cost or creating additional heat. Similarly, the controller 144 is configured to monitor and synchronize the rotation speed and operation of the exciter motors as may be desired. The controller 144 is also configured to ramp the output to the drive and exciter motors to limit current spikes at startup. The steering is controlled via the steering assembly 150 and the linear actuator 154, which may be driven by a solenoid, hydraulic motor, or similar element.

The cyclical nature of the ride-on roller 120 operation may be harnessed to reduce the power required from the engine 136. Energy may be captured and stored in the batteries 142 during machine deceleration and reused to accelerate the machine 120 as desired.

The controller 144 is also configured to monitor the drive system 134 as described with respect to the controller 96 of the trench roller 10. Routine maintenance and/or basic system information or warnings are monitored and reported to the operator via a display or the like. The controller 144 provides detailed troubleshooting information such as, e.g. operating data, short and open circuits, out of range parameters, and/or system faults, that would be helpful in troubleshooting the roller 120 for the purpose of maintenance.

Figure 4:
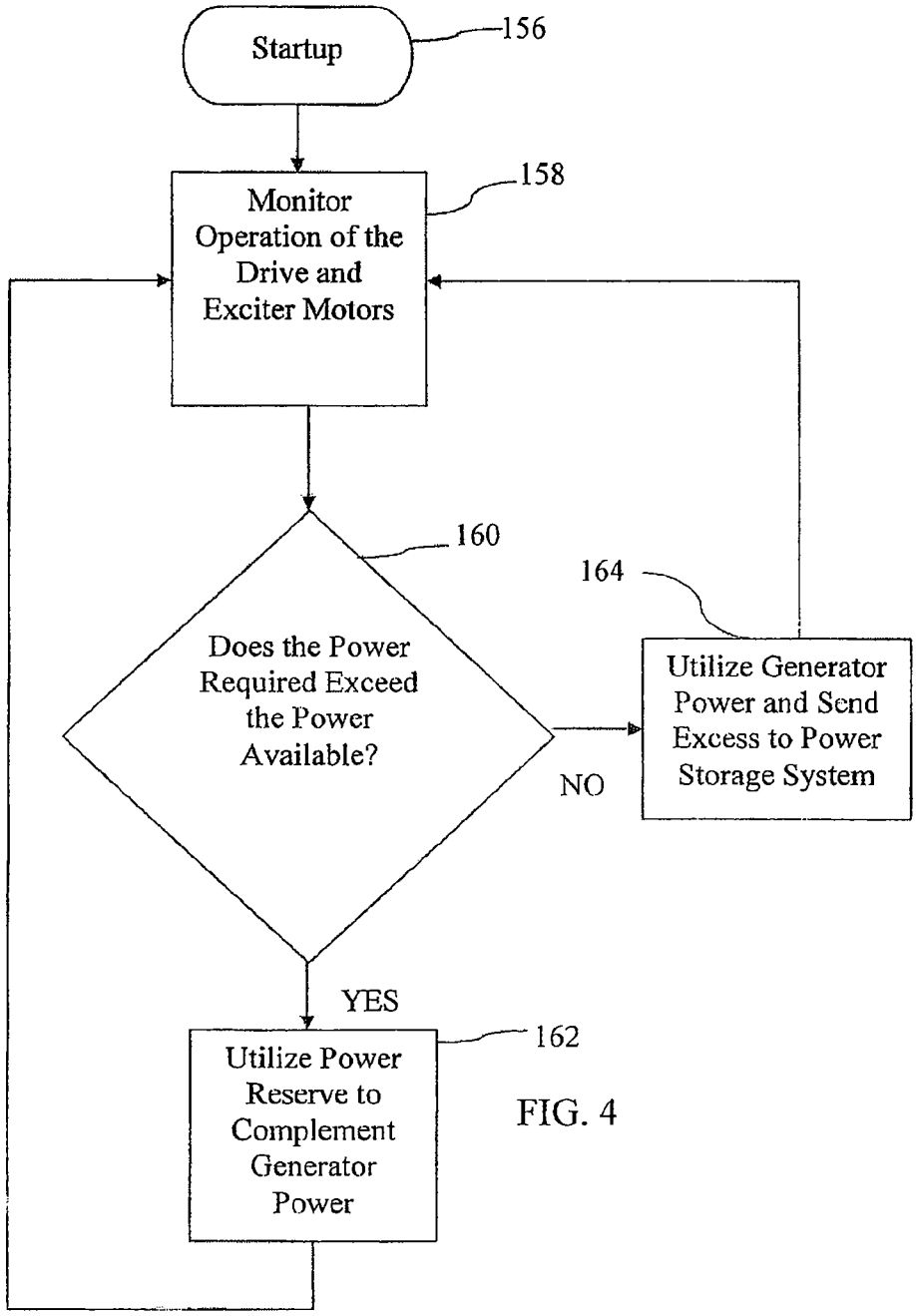
FIG. 4 is a flowchart illustrating a method of operating a drive system according to the present invention.

Now turning to FIG. 4, an exemplary method of operation of the drive system 92 or 134 according to an embodiment of the present invention is provided. Initially, at Block 156, travel and/or compaction action of the machine 10 or 120 is started. As has been discussed in detail herein, the drive system 92 or 134 may be configured to ramp up power output to the motors at startup such to reduce the magnitude of the power demand spikes that occur at startup. Next, the drive system 92 or 134 continually monitors the operation of the drive and exciter motors as previously discussed at Block 158. In particular, the controller 96 or 144 is configured to continually assess the power required to carry out commanded operation of the machine 10 or 120. In addition, the controller 96 or 144 is configured to continually compare the prevailing demand to the prevailing power output available from the generator at Block 160. If the power required to carry out operation exceeds the available power output from the generator, the controller 96 or 144 directs the drive system 92 or 134 to deliver supplemental or make-up power from the power storage system 98 or 142 at Block 162. In the alternative, if the available power output from the generator is sufficient to carry out operation of machine 10 or 120, the controller 96 or 144 is configured to direct the drive systems 92 and 134 to operate solely on the generator-supplied power and to direct any excess electrical to the power storage system at Block 164. In this way, the machine 10 or 120 is configured to continually operate off of the generator and charge the power storage system until the machine 10 or 120 experiences an increased power requirement, such as during startup operation or when traveling uphill, at which point power supplied by the generator is supplemented by reserve energy from the energy storage system. In addition, as mentioned above, the machine could be configured to automatically adjust the engine speed based on the power requirements of the task at hand.

Although the best mode contemplated by the inventors of carrying out the present invention is disclosed above, practice of the present invention is not limited thereto. It will be manifest that various additions, modifications and rearrangements of the aspects and features of the present invention may be made in addition to those described above without deviating from the spirit and scope of the underlying inventive concept. The scope of some of these changes is discussed above. The scope of other changes to the described embodiments that fall within the present invention but that are not specifically discussed above will become apparent from the appended claims and other attachments.

We claim:

1. A vibratory roller machine comprising:

(A) a chassis;

(B) at least one rotating drum assembly supporting the chassis on a surface, the rotating drum assembly including an exciter assembly that imparts vibrations to the drum;

(C) an electric motor that drives at least one of the exciter and the drum; and (D) a series hybrid drive in operable communication with the motor, the series hybrid drive including:

(i) a power storage system;

(ii) an engine;

(iii) a generator powered by the engine; and (iv) a controller operably coupled to the power storage system and the generator and controlling transmission of electrical power from the series hybrid drive to the motor;

wherein the controller controls the series hybrid drive to transmit power to the motor from the generator whenever the prevailing power output from the generator can meet a prevailing power demand of the vibratory roller machine and to deliver power to the motor from the power storage system when the prevailing power demand exceeds the prevailing generator power output.

2. The vibratory roller machine of claim 1, wherein the motor comprises a drive motor that that drives the drum, and further comprising an electrically powered exciter motor that drives the exciter assembly and that is driven by the series hybrid drive.

3. The vibratory roller machine of claim 1, wherein the controller controls the series hybrid drive to deliver power to the motor from the power storage system during at least one of start-up and high drive torque requirement.

4. The vibratory roller machine of claim 1, wherein the controller controls the generator to charge the power storage system when the prevailing power output from the generator exceeds the prevailing power demand of the vibratory roller machine.

5. The vibratory roller machine of claim 1, wherein the power storage system comprises a battery bank comprising at least one battery.

6. The vibratory roller machine of claim 1, wherein the power storage system comprises a capacitor bank comprising at least one capacitor.

7. The vibratory roller machine of claim 1, further comprising a remote control receiver in operable communication with a remote control transmitter to receive signals from the remote control transmitter for operating the vibratory roller machine.

8. The vibratory roller machine of claim 1, wherein the machine comprises a walk-behind trench roller comprising, a front subframe and a rear subframe pivotally coupled to one another; and a front drum assembly movably mounted to the front subframe and a rear drum assembly movably mounted to the rear subframe, each having an exciter assembly associated therewith, and wherein the motor comprises a drive motor for the front drum assembly, and further comprising another electric drive motor for the rear drum assembly and first and second electric exciter motors that drive the exciter assemblies, all of the motors being powered by the series hybrid drive.

9. The vibratory roller machine of claim 1, wherein the machine comprises ride-on roller comprising, (i) a front subframe and a rear subframe pivotally coupled to one another;

(ii) a front drum assembly movably mounted to the front subframe and a rear drum assembly movably mounted to the rear subframe;

(iii) a support platform disposed on one of the front and rear subframes and including an operator's seat; and (iv) a steering assembly for controlling steering of the roller.

10. A vibratory roller machine comprising:

(A) a chassis comprising a front subframe and a rear subframe pivotally coupled to one another;

(B) a front drum assembly and a rear drum assembly movably mounted to the front and rear subframe respectively, wherein at least one of the front and rear drum assemblies are configured to compact the ground over which the vibratory roller machine travels;

(C) at least one of a front and rear exciter assemblies associated with at least one of the front and rear drum assemblies, respectively;

(D) front and rear electric drive motors that drive the front and rear drums to rotate;

(E) at least one of a front and rear exciter motor that drive the front and rear exciter assemblies; and (F) a series hybrid drive that supplies electrical power to all of the motors, the series hybrid drive assembly including, (i) a power storage system;

(ii) an engine;

(iii) a generator configured to receive power from the engine; and (iv) a controller operably coupled to the power storage system and the generator and controlling transmission of electrical power from the series hybrid drive to the motor, wherein the controller controls the series hybrid drive to transmit power to motors from the generator whenever the prevailing power output from generator can meet a prevailing power demand of the vibratory roller machine and to deliver power to the motors from the power storage system when the prevailing power demand exceeds the prevailing generator power output.

11. The vibratory roller machine of claim 10, wherein, when the demanded power is less than the prevailing generator power output, the excess available generator power is utilized to charge the power storage system.

12. The vibratory roller machine of claim 10, wherein each of the front and rear drum assemblies comprises a pair of drums, each of which is driven by a respective electric drive motor.

13. The vibratory roller machine of claim 10, wherein the vibratory roller machine is a trench roller, and further comprising an actuator coupled between the front and rear subframes and configured to enable pivotal steering of the trench roller.

14. The vibratory roller machine of claim 10, wherein the vibratory roller machine is a ride-on roller having an operator's seat.

15. A method of operating a vibratory roller machine, the method comprising the steps of:

(A) monitoring power required of at least one drive motor and at least one exciter motor;

(B) determining whether the power required of the at least one drive motor and the at least one exciter motor exceeds an available power output from a generator;

(C) if the power required exceeds the available generator power output, supplying power to the motors from a power storage system.

16. The method of claim 15, further comprising utilizing excess generator power to charge the power storage system if the power required is less than the available generator power output.

17. The method of claim 15, further comprising the step of utilizing power from the power storage system automatically at electric motor startup.

18. The method of claim 17, further comprising the step of ramping up power of the at least one exciter motor at a predetermined rate to limit the power required at startup.

19. The method of claim 15, wherein the vibratory roller machine is one of a walk-behind trench roller and a ride-on roller.

* * * * *

UNITED STATES PATENT AND TRADEMARK OFFICE

CERTIFICATE OF CORRECTION

PATENT NO. : 8,585,317 B1
APPLICATION NO. : 13/466239
DATED : November 19, 2013
INVENTOR(S) : Sina It is certified that error appears in the above-identified patent and that said Letters Patent is hereby corrected as shown below:

IN THE CLAIMS

CLAIM 17 Delete "automatically"
Col. 14, Line 52

Signed and Sealed this
Fourth Day of February, 2014

Michelle K. Lee

Michelle K. Lee
*Deputy Director of the United States Patent and Trademark Office*